US010464710B2

(12) United States Patent
Dehghani

(10) Patent No.: US 10,464,710 B2
(45) Date of Patent: Nov. 5, 2019

(54) TWIN-GLASS COMBINATIONAL DRINKING APPARATUS

(71) Applicant: Saeid Morleza Dehghani, Shiraz (IR)

(72) Inventor: Saeid Morleza Dehghani, Shiraz (IR)

( * ) Notice: Subject to any disclaimer, the term of this patent is extended or adjusted under 35 U.S.C. 154(b) by 75 days.

(21) Appl. No.: 15/878,332

(22) Filed: Jan. 23, 2018

(65) Prior Publication Data

US 2019/0225373 A1 Jul. 25, 2019

(51) Int. Cl.
*B65D 21/02* (2006.01)
*A47G 19/22* (2006.01)

(52) U.S. Cl.
CPC ..... *B65D 21/0228* (2013.01); *A47G 19/2255* (2013.01); *A47G 19/2266* (2013.01)

(58) Field of Classification Search
CPC .. A47G 19/06; A47G 19/065; A47G 19/2272; B65D 21/0228; B65D 51/28
See application file for complete search history.

(56) References Cited

U.S. PATENT DOCUMENTS 5,806,765 A * 9/1998 Weinstein ..... A47G 21/18 215/388
6,425,480 B1 * 7/2002 Krueger ..... A47G 19/065 206/217
7,111,748 B2 * 9/2006 Cha ..... A47G 19/065 220/4.27
2008/0173650 A1 * 7/2008 Roth ..... A47J 41/0044 220/574.1

* cited by examiner

*Primary Examiner* — Andrew T Kirsch

(57) ABSTRACT

A combinational drinking apparatus for a user comprising a first container and a second container is disclosed. The first container receive and store a first fluid, and an upper section of the first container includes male threaded sections. The second container containing a second fluid, is configured to releasably mate the open ends of the first container using a cap member. The cap member comprises a plurality of female threaded sections to screwingly receive the male threaded sections disposed on the first container. A primary straw member is configured to extend downwardly to the cavity defined in the first container. The primary straw member is juxtaposed side-by-side with a secondary straw member in the second container to allow the user to selectively draw either first fluid, second fluid, or the combination of first and second fluid.

12 Claims, 5 Drawing Sheets

TWIN-GLASS COMBINATIONAL DRINKING APPARATUS

BACKGROUND OF THE INVENTION

Drinking cup or containers is an indispensable item as the consumers often wish to buy different drinks when they visit a coffee shop, restaurant, hotel or any other related stores. However, there is a constraint for the consumers when they could taste only one drink at a time. Nowadays, people want to order two or more different drinks according to their desires and taste preferences and they need to change the way of drinking the two different drinks. But in most of the places, we can see only one drinking glass wherein the drinks are selectively mixed and served to the consumer. Again, this has limitations for the consumer as they could not feel all the tastes of the drinks when consumed together.

Drinking glasses having one or more partitioned compartments to hold different drinks are known in the art. A partition wall dividing the drinking glass to carry two different drinks and the user could consume the drinks together or separately using the straws. However, this increases the size of the drinking glass and will have constraints related to the design. Further, the lid must be provided to seal both the compartments of the glass without mixing up the contents. So, there exists a lack of possibility to choose several drinks together in an ordinary glass, that the consumer could choose the taste and type of drink as her/his desire. Further, the lack of variety of styles in drinking different drinks in coffee shops, hotels, restaurants would also lead to loss of business for the shops. Nowadays the consumers are expecting to have the possibility of choosing some drinks containing all the flavors such as sour, sweet, bitter, cold for drinking at a time.

Thus, there is a clear and present need for a drinking apparatus to allow a user to drink two or more drinks separately or mixed with each other. Further, there is a need for a combinational drinking apparatus with a straw assembly to allow one or two users to conveniently drink one or more fluids with different tastes from a single drinking container.

SUMMARY OF THE INVENTION

The present invention relates to a drinking apparatus, and more particularly relates to a twin-glass combinational drinking apparatus to allow a user to drink two or more drinks separately or mixed with each other.

In one embodiment, the combinational drinking apparatus for a user comprises a first container configured to define a cavity to receive and store a first fluid, wherein an upper section of the first container comprises one or more male threaded sections. A second container containing a second fluid is configured to releasably mate the open ends of the first container using a cap member, wherein the cap member comprises a plurality of female threaded sections to screwingly receive the male threaded sections disposed on the first container.

In one embodiment, a primary straw member is configured to extend downwardly to the cavity defined in the first container, wherein the primary straw member is juxtaposed side-by-side with a secondary straw member in the second container to allow the user to selectively draw either the first fluid, only the second fluid, or the combination of the first and the second fluids.

In another embodiment, the combinational drinking apparatus comprises a first container configured to define a cavity to receive and store a first fluid and second container containing a second fluid is configured to releasably mate the open ends of the first container using a cap member. The cap member is configured to have a substantially grooved concave section to receive an upper section of the first container for a snap-fit locking configuration.

In another embodiment, the first container and the second container in the apparatus is bonded using an adhesive lining. This design eliminates the use of the cap member and allows the second container to directly sit on the first container in a snug fit configuration.

In certain embodiments, the containers in the combinational drinking apparatus are made from at least one of a crystal, polyethylene as a disposable transparent crystal, a ceramic and a plastic material. The container could be selected from at least one of a cup, a glass, a receptacle, a vessel, a holder, a bowl, a drinkware and a mug.

One aspect of the present disclosure is directed to a combinational drinking apparatus for a user, comprising: (a) a first container configured to define a cavity to receive and store a first fluid, wherein an upper section of the first container comprises one or more male threaded sections; (b) a second container containing a second fluid is configured to releasably mate the open ends of the first container using a cap member, wherein the cap member comprises a plurality of female threaded sections to screwingly receive the male threaded sections disposed on the first container; and (c) a primary straw member is configured to extend downwardly to the cavity defined in the first container, wherein the primary straw member is juxtaposed side-by-side with a secondary straw member in the second container to allow the user to selectively draw either first fluid, second fluid, or the combination of first and second fluid.

In one embodiment, the combinational drinking apparatus further comprises an adhesive lining configured to bond the first container and the second container. In one embodiment, the container is made from at least one of a crystal, a ceramic and a plastic material. In another embodiment, the first container and the second container are screwed together via the threaded sections by torsion or compression forces. In one embodiment, the cap member comprises an opening to receive the primary straw member, wherein the primary straw member extends downwardly to the cavity defined in the first container. In another embodiment, the primary straw member is configured to have fluid communication with the first fluid in the first container. In one embodiment, the secondary straw member is configured to have fluid communication with the second fluid in the second container.

In one embodiment, the container is selected from at least one of a cup, a glass, a receptacle, a vessel, a holder, a bowl, a drinkware and a mug. In another embodiment, the first container comprises a stem member mounted on a base configured to assist the user in lifting the apparatus. In one embodiment, the second container comprises a lid assembly to releasably engage the open ends for closing the second container. In another embodiment, the first fluid drawn through the primary straw member and the second fluid drawn through the secondary straw member remains separated until exiting the primary and the secondary straw members.

In one embodiment, the primary straw member and the secondary straw member are joined together at the upper section using a pin, to securely attach the straw members together while the user drinks the fluid using this apparatus. In one embodiment, the containers are fabricated by a molding process. In one embodiment, the containers are fabricated by a glass making technique. In an embodiment, a method of drinking one or more fluids with different tastes using the combinational drinking apparatus is disclosed.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION

A description of embodiments of the present invention will now be given with reference to the figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The present invention generally relates to a twin-glass drinking apparatus, and more particularly relates to a combinational drinking apparatus to enable a user to drink two or more drinks separately or mixed with each other. The design of straws is also considered important. Straws are primarily used to draw fluid from the receptacle. However, the design of the straw plays a major role when a consumer wants to drink two different liquids having different tastes from a single drinking container at a time. Most of the currently available straws are configured to slide into the openings in the respective containers to help the user to draw the fluid. But there are limitations in the current design which does not allow the user to conveniently drink.

Figure 1:
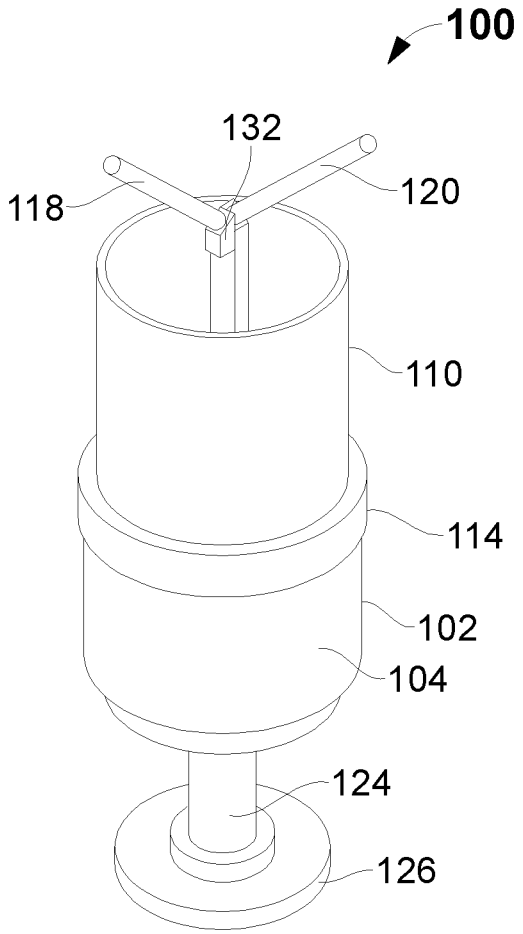
FIG. 1 illustrates a schematic of a combinational drinking apparatus according to one embodiment.

According to an embodiment of the invention as shown in FIG. 1, a schematic of a combinational drinking apparatus 100 is disclosed. The combinational drinking apparatus 100 is a twin-glass drinking means configured to allow a user to drink two or more drinks separately or mixed with each other.

Figure 2A:
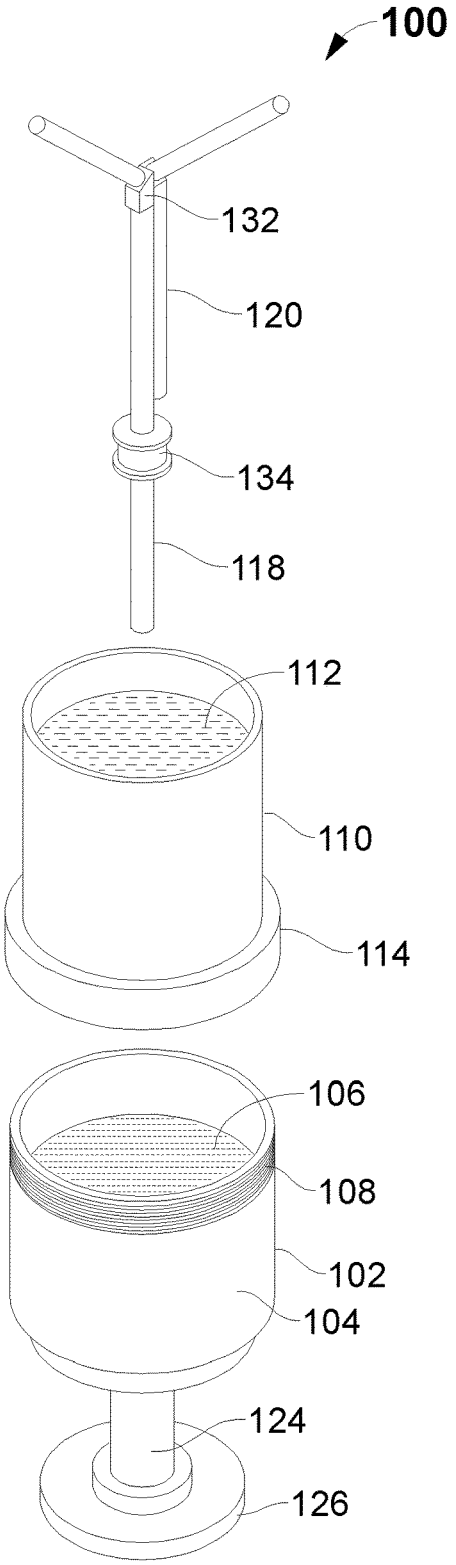
FIG. 2A illustrates an exploded view of the combinational drinking apparatus, according to one embodiment.

FIG. 2A illustrates an exploded view of the combinational drinking apparatus 100, according to one embodiment. The combinational drinking apparatus 100 comprises a first container 102 configured to define a cavity 104 to receive and store a first fluid 106, wherein an upper section of the first container 102 comprises one or more male threaded sections 108. A second container 110 containing a second fluid 112 is configured to releasably mate the open ends of the first container 102 using a cap member 114, wherein the cap member 114 comprises a plurality of female threaded sections (not shown) to screwingly receive the male threaded sections 108 disposed on the first container 102.

According to one embodiment as shown in FIG. 1, the combinational drinking apparatus 100 further comprises a primary straw member 118 configured to extend downwardly to the cavity 104 defined in the first container 102, wherein the primary straw member 118 is juxtaposed side-by-side with a secondary straw member 120 in the second container 110 to allow the user to selectively draw either the first fluid 106, only the second fluid 112, or the combination of the first and the second fluids (106, 112). This straw configuration in the combinational drinking apparatus 100 allows a user to conveniently drink different fluids from both the containers (102, 110) to feel the combination of different tastes at the same time.

In one embodiment as shown in FIG. 1, the primary straw member 118 is configured to have fluid communication with the first fluid 106 in the first container 102. On the other hand, the secondary straw member 120 is configured to have fluid communication with the second fluid 112 in the second container 110. This allows the user to easily draw the fluid from either the first or second container (102, 110). The user could easily maneuver the primary and the secondary straw members (118, 120) and draw both the fluids simultaneously to make the combination of the different tastes from the fluids disposed in the containers (102, 110).

Figure 2B:
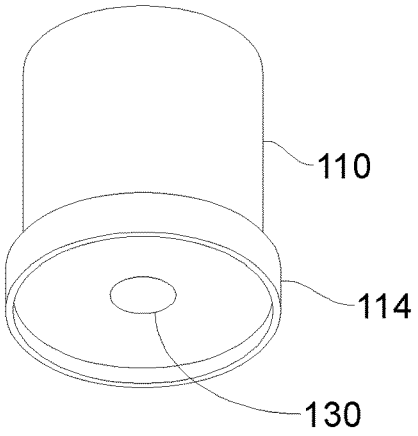
FIG. 2B illustrates a bottom view of a second container showing an opening, according to one embodiment.

In alternate embodiment as shown in FIG. 2A, the cap member 114 in the second container 110 comprises an opening 130 to receive the primary straw member 118 which extends downwardly to the cavity 104 defined in the first container 102 as shown in FIG. 2B. The opening 130 in the middle of the cap member 114 acts as a base to receive and place the plug member 134 and the primary straw member 118. So, the user could allow the second fluid 112 in the second container 110 to mix with the first container 102 and the user could have the combination of drinking both the first and second fluids together using the primary straw member 118.

In one embodiment of the present invention as shown in FIG. 2A, the first container 102 and the second container 110 in the combinational drinking apparatus 100 are screwed together via the threaded sections by torsion or compression forces. The mating of the male and female threaded sections gives a soothing feel for the user and this allows for secured fitting of both the containers (102, 110) thereby avoiding the leakage of the fluids in the containers (102, 110). The first container 102 in the combinational drinking apparatus 100 comprises a stem member 124 mounted on a base member 126 configured to assist the user in lifting the apparatus 100.

In alternate embodiment, the primary straw member 118 could also be used to drink either the first or second fluids separately. In the same embodiment as shown in FIG. 2B, if the user wants to drink only the second fluid 112 in the second container 110, the secondary straw member 120 which is in communication with the second fluid 112 could be used. Besides using the primary straw member 118 for drinking the fluids, it could also be used as a covering for the opening 130 in the cap member 114 of the second container 110 so that when the user picks the straw from the opening 130, the second fluid 112 from the second container 110 could mix with the first fluid 106 in the first container 102. The primary straw member 118 could be used to drink the two fluids from the apparatus 100 regarding the tendency of the user.

In one embodiment as shown in FIG. 2A, the containers (102, 110) in the combinational drinking apparatus 100 are made from at least one of a crystal, polyethylene as a disposable transparent crystal, a ceramic and a plastic material. Preferably, the containers (102, 110) could be made from disposable transparent plastic crystals for better appealing effect. However, other materials also could be used in making the containers (102, 110) which would improve the appearance of the apparatus 100. The container (102, 110) is selected from at least one of a cup, a glass, a receptacle, a vessel, a holder, a bowl, a drinkware and a mug.

In another embodiment as shown in FIG. 1, a different configuration of the combinational drinking apparatus 100 is disclosed. The combinational drinking apparatus 100 comprises a first container 102 configured to define a cavity 104 to receive and store a first fluid 106 and second container 110 containing a second fluid 112 is configured to releasably mate the open ends of the first container 102 using a cap member 114. The cap member 114 is configured to have a substantially grooved concave section (not shown) to receive an upper section of the first container 102 for a snap-fit locking configuration. A primary straw member 118 is configured to extend downwardly to the cavity 104 defined in the first container 102, wherein the primary straw member 118 is juxtaposed side-by-side with a secondary straw member 120 in the second container 110 to allow the user to selectively draw either first fluid 106, second fluid 112, or the combination of first and second fluid. This configuration allows the user to conveniently place the two containers (102, 110) together by a manual pushing effort on the table to make the apparatus 100 readily available for use.

Figure 3:
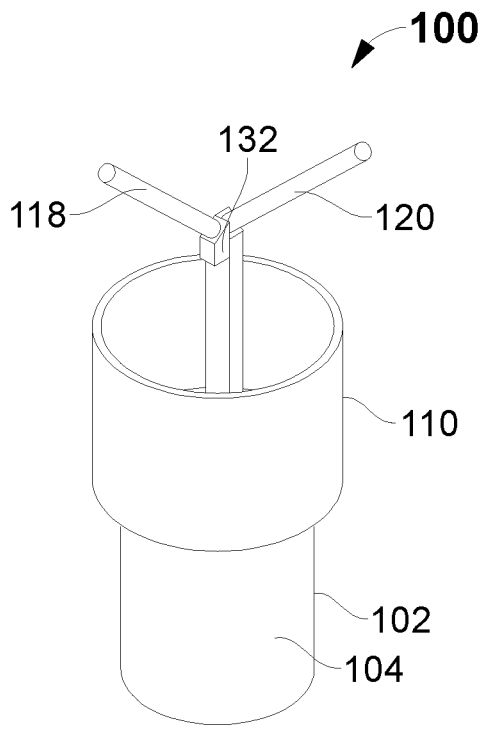
FIG. 3 illustrates a schematic of the combinational drinking apparatus according to another embodiment.
Figure 4:
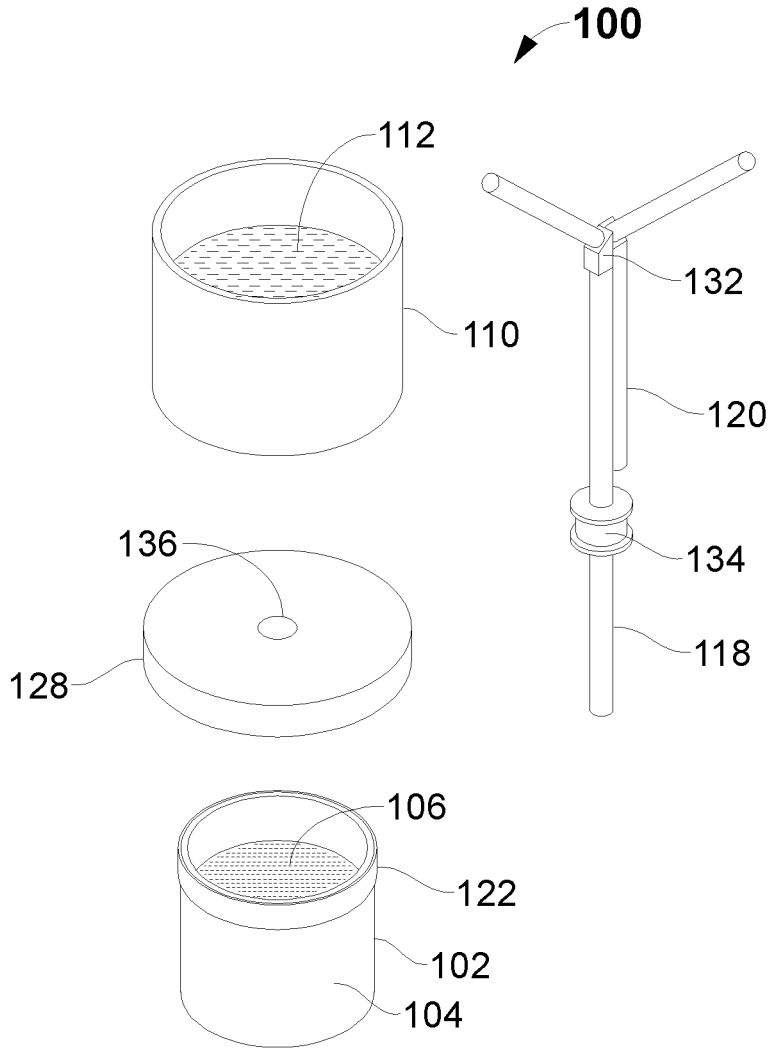
FIG. 4 illustrates the exploded view of the combinational drinking apparatus, according to another embodiment.

In a different embodiment as shown in FIG. 3, a schematic of the combinational drinking apparatus 100 is disclosed. In this embodiment, the first container 102 and the second container 110 of the combinational drinking apparatus 100 are produced in the form of glasses that are separated by a crust (not shown). The crust is configured to have an opening 130 in the middle section. As shown in FIG. 4, the crust is made in the form of a lid assembly 128 to releasably engage the open ends of the first container 102 and thereafter, the second container 110 is bonded to the first container 102 using an adhesive for a tight-fit configuration.

As shown in FIG. 4, the lid assembly 128 is configured to have an aperture 136 in the middle to allow the user to slide either the primary straw member 118 to reach the cavity 104 of the first container 102 depending on their requirements for drinking the fluid using the apparatus 100. The open ends of the second container 110 could be left free without any closing member. as shown in FIG. 3 and the user could simply place the straw members to selectively draw either first fluid, second fluid, or the combination of first and second fluid. Here, the plug member 134 is configured to disposed on the aperture 136 to allow the contents of the first container 102 and the second container 110 to mix with each other. This is considered as the alternative embodiments of the present invention.

In another embodiment as shown in FIG. 4, the first container 102 and the second container 110 of the combinational drinking apparatus 100 are bonded together using an adhesive lining 122. Preferably, any resin based adhesives could be used to seal the containers (102, 110). However, other fastening methods and systems could be used to securely attach the containers in the apparatus 100 without leaking the contents. This design is simple and does not include any cap member 114 to provide the sealing of the containers (102, 110). During the fabrication of the containers (102, 110), the strong adhesive material could be provided as a lining in the upper surface of the first container 102 so that, the second container 110 could be easily bonded on it. This is considered as alternative embodiment for the present invention.

Figure 5A:
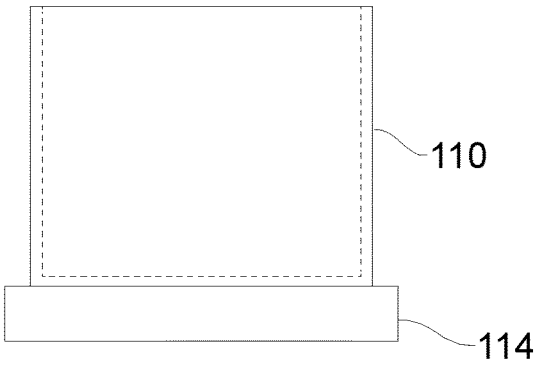
FIG. 5A shows a side view of a second container of the combinational drinking apparatus according to an embodiment.

FIG. 5A shows a side view of second container 110 of the combinational drinking apparatus 100 according to an embodiment. A method of drinking one or more fluids with different tastes using the combinational drinking apparatus 100 is disclosed. Once the consumer reached the coffee shop or restaurant, the vendor could place the first container 102 on the table and pout the first fluid 106 to the desired level as shown in FIG. 2A. The fluid could be at least one of a cherry juice, apple juice, coffee, tea, sweet water, lime water, salt water, aloe vera juice, cranberry juice, orange juice, carrot juice, cocoa, hot milk, fantasy drinks, nectars, distillates or any other fruit juices which the user wish to drink. However, it is not limited to these fluids, but could be expanded to have any other drinks with different viscosity which the user wants to try and feel the combination of tastes. In one embodiment, there is an opening in the form of a small hole in the middle of the glass.

Figure 5B:
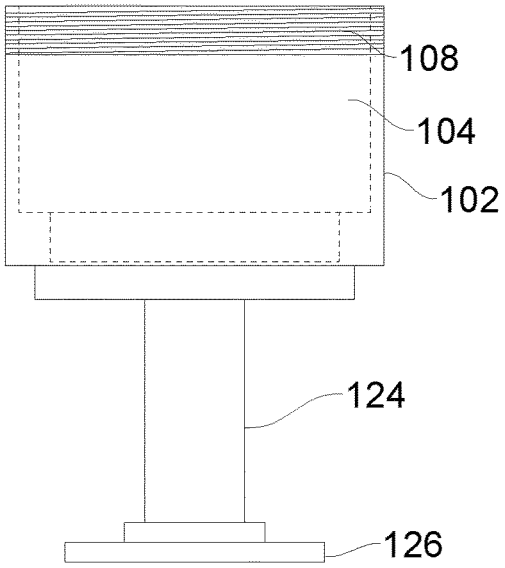
FIG. 5B shows a side view of a first container of the combinational drinking apparatus according to an embodiment.

The second container 110 is placed on the first container 102 and the cap member 114 is screwed using the threaded sections by providing torsion or compression forces for the snug fitting as shown in FIG. 5B. This fitting does not allow any leakage of the fluid contents from the container. The vendor could pour the first fluid 106 in the first container 102 and the second container 110 is screwed on the first container 102 using either the threaded sections or grooved concave section. Then the second fluid 112 is poured in the second container 110 and then the straw members (118, 120) are placed in the apparatus 100 in such a way that the primary straw member 118 slid into the opening 130 provided in the cap member 114 to reach the cavity 104 defined in the first container 102 as shown in FIG. 2B. This allows the primary straw member 118 to have fluid communication with the first fluid 106 and the secondary straw member 120 to have fluid communication with the second fluid 112.

Finally, when the user starts drawing the drink, the first fluid 106 drawn through the primary straw member 118 and the second fluid 112 drawn through the secondary straw member 120 remains separated until exiting the primary and the secondary straw members (118, 120) as shown in FIG. 2A. The primary and secondary straw members (118, 120) are joined together at the upper section using a pin 132, to securely attach the straw members together while the user drinks the fluid using this apparatus 100. The user could selectively draw either first fluid, second fluid, or the combination of first and second fluid using the primary straw member 118 based on their own desire to enjoy their tastes. The plug member 134 and the primary straw member 118 is configured to combine both the fluids and the primary straw member 118 prolongs through the opening 130 and when the plug member 134 and the primary straw member 118 are removed, the second fluid 112 gets mixed with the first fluid 106. Therefore, the user could enjoy the combination of different fluids from the apparatus 100 drawn using the primary straw member 118.

Figure 5C:
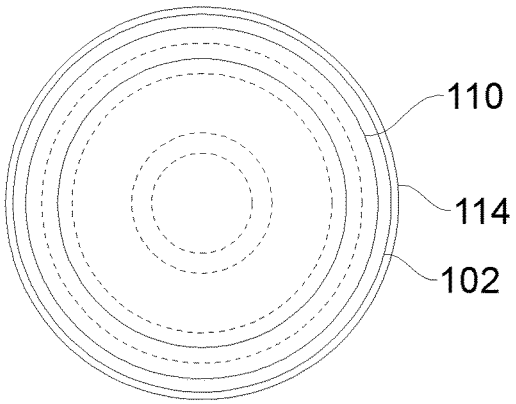
FIG. 5C shows a top view of the combinational drinking apparatus according to an embodiment.

In one embodiment, the method of making the containers in the apparatus 100 is disclosed. Preferably, the first container 102 could be selected from a regular glass or a cup. However, the first and second container (102, 110) is fabricated using a molding process. A plastic injection molding process could be used to fabricate the first container 102 with or without the cap member 114 as shown in FIG. 5C. The cap member 114 is provided with threaded sections (not shown) to mate with the counterpart. The container 110 also could be made without the cap member 114 wherein the adhesive lining 122 could be disposed in the upper surface of the first container 102 to mate with its counterpart as shown in FIG. 4. Both the designs of the apparatus could be made from the disposable paper.

Preferably, the containers (102, 110) could be made of crystal and porcelain made by molding and glass making or with the related glass making techniques. The containers (102, 110) could also be made disposable as shown in FIG. 1. The aesthetic appearance of the container (102, 110) could be enhanced to have a fantasy look in different sizes and colors to attract the consumers across all ages especially for children and adults. This helps to target coffee company and coffeehouse chain such as Starbucks™ to market this apparatus 100 for their consumers to provide the user possibility of drinking and enjoying their various tastes such as Espresso, Brewed coffee, Ice tea, Nougat and so on. The apparatus 100 allows the users to enjoy the possibility of mixing the fluids themselves and not allowing the vendors involvement anymore.

The advantage of the present invention is that the apparatus 100 is not only providing the possibility of drinking two or more fluids with different tastes but also to have a different unique way of drinking them. The configuration of the containers (102, 110) and the straw members (118, 120) enhances the appearance and lure the consumers to use them for drinking. Several drinks could be mixed and poured into both the containers (102, 110) so that the user could taste from various combinations drinks. Further, the juxtaposed configuration of straw members (118, 120) helps one or more users to draw the desired fluid from the containers (102, 110). The position of the straw members (118, 120) could be easily changed using the plug member 134 which is advantageous in changing the way of drinking and getting various tastes of drinks simultaneously. Based on their desire, the user could also drink the fluid separately as they normally do with existing drinking glasses.

The combinational drinking apparatus 100 would help the users who are looking for the combination of warm, cool, sweet, sour and bitter drinks with different way of drinking it. This is very convenient for users across all ages but especially for young couples and children, this design would attract more and more users to consume the drinks of their own desires. This apparatus 100 could enhance the beverage market and create diversity for individuals which in turn boosts the tourism and recreation industry.

One aspect of the present disclosure is directed to a combinational drinking apparatus 100. The apparatus 100 may comprise a first container 102 configured to define a cavity 104 to receive and store a first fluid 106, wherein an upper section of the first container 102 comprises one or more male threaded sections. The apparatus 100 may further comprise a second container 110 containing a second fluid 112 is configured to releasably mate the open ends of the first container 102 using a cap member 114, wherein the cap member 114 comprises a plurality of female threaded sections to screwingly receive the male threaded sections 108 disposed on the first container 102. Further still, the apparatus 100 may further comprise a primary straw member 118 is configured to extend downwardly to the cavity 104 defined in the first container 102, wherein the primary straw member 118 is juxtaposed side-by-side with a secondary straw member 120 in the second container 110 to allow the user to selectively draw either first fluid, second fluid, or the combination of first and second fluid.

The combinational drinking apparatus 100 may further comprise an adhesive lining 122 configured to bond the first container 102 and the second container 110. The container may be made from at least one of a crystal, a ceramic and a plastic material. The first container 102 and the second container 110 may be screwed together via the threaded sections by torsion or compression forces. The cap member 114 may comprise an opening 130 to receive the primary straw member 118, wherein the primary straw member 118 extends downwardly to the cavity 104 defined in the first container 102. The primary straw member 118 may be configured to have fluid communication with the first fluid 106 in the first container 102. The secondary straw member 120 may be configured to have fluid communication with the second fluid 112 in the second container 110.

The container may be selected from at least one of a cup, a glass, a receptacle, a vessel, a holder, a bowl, a drinkware and a mug. The first container 102 may comprise a stem member 124 mounted on a base 126 configured to assist the user in lifting the apparatus 100. The first fluid 106 drawn through the primary straw member 118 and the second fluid 112 drawn through the secondary straw member 120 may remain separated until exiting the primary and the secondary straw members.

In one example, the primary straw member 118 and the secondary straw member 120 may be joined together at the upper section using the pin, 132, to securely attach the straw members together while the user drinks the fluid using this apparatus 100. In one embodiment, the containers are fabricated by either a molding process or by a glass making technique.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method.

Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein. While the above is a complete description of the preferred embodiments of the invention, various alternatives, modifications, and equivalents may be used. Therefore, the above description and the examples should not be taken as limiting the scope of the invention, which is defined by the appended claims.

The invention claimed is:

1. A twin-glass combinational drinking apparatus for a user, comprising:

a first container configured to define a cavity to receive and store a first fluid, wherein an upper section of the first container comprises one or more male threaded sections, wherein the first container comprises a stem member mounted on a base configured to assist the user in lifting the apparatus;

a second container containing a second fluid is configured to releasably mate with an open end of the first container using a cap member, wherein the cap member comprises a plurality of female threaded sections to screwingly receive the male threaded sections disposed on the first container;

a plug member configured to be disposed on an opening of the cap member to mix the first fluid and the second fluid in the apparatus; and a primary straw member configured to extend downwardly to the cavity defined in the first container, via the opening of the cap member, wherein the primary straw member is juxtaposed side-by-side with a secondary straw member in the second container to allow the user to selectively draw either first fluid, second fluid, or the combination of first and second fluid.

2. The twin-glass combinational drinking apparatus of claim 1, wherein the container is made from at least one of a crystal, a ceramic and a plastic material.

3. The twin-glass combinational drinking apparatus of claim 1, wherein the first container and the second container are screwed together via the threaded sections by torsion or compression forces.

4. The twin-glass combinational drinking apparatus of claim 1, wherein the primary straw member is configured to have fluid communication with the first fluid in the first container.

5. The twin-glass combinational drinking apparatus of claim 1, wherein the secondary straw member is configured to have fluid communication with the second fluid in the second container.

6. The twin-glass combinational drinking apparatus of claim 1, wherein the container is selected from at least one of a cup, a glass, a receptacle, a vessel, a holder, a bowl, a drinkware and a mug.

7. The twin-glass combinational drinking apparatus of claim 1, wherein a lid assembly is configured to releasably engage the open ends of the first container for a tight-fit connection with the second container.

8. The twin-glass combinational drinking apparatus of claim 1, wherein the first fluid drawn through the primary straw member and the second fluid drawn through the secondary straw member remains separated until exiting the primary and the secondary straw members.

9. The twin-glass combinational drinking apparatus of claim 1, wherein the primary straw member and the secondary straw member are joined together at the upper section using a pin, to securely attach the straw members together.

10. The twin-glass combinational drinking apparatus of claim 1, wherein the containers are fabricated by a molding process.

11. The twin-glass combinational drinking apparatus of claim 1, wherein the containers are fabricated by a glass making technique.

12. A twin-glass combinational drinking apparatus for a user, comprising:

a first container configured to define a cavity to receive and store a first fluid, wherein the first container comprises a stem member mounted on a base configured to assist the user in lifting the apparatus;

a second container containing a second fluid is configured to releasably mate with an open end of the first container using a cap member, wherein the cap member is configured to have a substantially grooved concave section to receive an upper section of the first container for a snap-fit locking configuration;

a plug member configured to be disposed on an opening of the cap member to mix the first fluid and the second fluid in the apparatus; and a primary straw member is configured to extend downwardly to the cavity defined in the first container, via the opening of the cap member, wherein the primary straw member is juxtaposed side-by-side with a secondary straw member in the second container to allow the user to selectively draw either first fluid, second fluid, or the combination of first and second fluid.

* * * * *